US007407049B2

(12) United States Patent
Aulanko et al.

(10) Patent No.: US 7,407,049 B2
(45) Date of Patent: Aug. 5, 2008

(54) PALLET ARRANGEMENT FOR A PEOPLE MOVER

(75) Inventors: Esko Aulanko, Kerava (FI); Jorma Mustalahti, Hyvinkää (FI); Marc Ossendorf, Bochum (DE)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 11/584,593

(22) Filed: Oct. 23, 2006

(65) Prior Publication Data

US 2007/0036626 A1 Feb. 15, 2007

Related U.S. Application Data

(63) Continuation of application No. PCT/FI2005/000167, filed on Mar. 29, 2005.

(30) Foreign Application Priority Data

Apr. 22, 2004 (FI) ..... 20040565

(51) Int. Cl.
*B66B 23/12* (2006.01)

(52) U.S. Cl. ..... 198/333

(58) Field of Classification Search ..... 198/333, 198/326, 327

See application file for complete search history.

(56) References Cited

U.S. PATENT DOCUMENTS

| | | | | | |
|---|---|---|---|---|---|
| 2,152,795 | A * | 4/1939 | Dunlop | 198/333 |
| 4,295,556 | A * | 10/1981 | Saito et al. | 198/325 |
| 4,362,232 | A * | 12/1982 | Saito et al. | 198/333 |
| 4,570,781 | A * | 2/1986 | Kappenhagen | 198/333 |
| 5,186,301 | A * | 2/1993 | Rivera | 198/333 |
| 5,350,049 | A * | 9/1994 | Ahls et al. | 198/333 |
| 5,411,127 | A * | 5/1995 | Findlay | 198/333 |
| 5,697,487 | A * | 12/1997 | Engelke et al. | 198/333 |
| 5,738,201 | A * | 4/1998 | Findlay et al. | 198/333 |
| 5,810,148 | A * | 9/1998 | Schoeneweiss | 198/333 |
| 6,085,891 | A | 7/2000 | Behle et al. | |
| 6,241,071 | B1 * | 6/2001 | Yamashita et al. | 198/333 |
| 6,283,270 | B1 | 9/2001 | Robibero et al. | |
| 6,398,003 | B1 | 6/2002 | Jasinetzky | |
| 6,978,876 | B1 * | 12/2005 | Tsukahara et al. | 198/333 |
| 7,264,105 | B2 * | 9/2007 | Illedits | 198/326 |

FOREIGN PATENT DOCUMENTS

| | | |
|---|---|---|
| DE | 44 33 622 A1 | 3/1996 |
| DE | 199 19 710 A1 | 11/2000 |
| EP | 1 205 419 A | 5/2002 |
| JP | 08 059159 A | 3/1996 |
| JP | 09 104584 A | 4/1997 |

* cited by examiner

*Primary Examiner*—Douglas A Hess
(74) *Attorney, Agent, or Firm*—Venable LLP; Robert Kinberg

(57) ABSTRACT

A pallet arrangement for a people mover includes a plurality of pallets arranged one after the other to form a track. Each pallet comprises a pallet body, at least one surfacing element attached to the pallet body and a fastening mechanism to attach the at least one surfacing element to the pallet body. The fastening mechanism comprises at least one coupling element included in each surfacing element of the pallet, a form-locking groove included in the pallet body of the pallet and a locking element performing a locking operation with a locking movement and a releasing operation with a releasing movement. The locking element acts on all the coupling elements in the form-locking groove of the pallet body substantially simultaneously during the locking movement and the releasing movement.

8 Claims, 5 Drawing Sheets

PALLET ARRANGEMENT FOR A PEOPLE MOVER

CROSS-REFERENCE TO RELATED APPLICATIONS

This application is a continuation of International Application No. PCT/FI2005/000167, filed Mar. 29, 2005, designating the United States and claiming priority from Application FI20040565 filed in Finland on Apr. 22, 2004. The disclosures of both foregoing applications are incorporated herein by reference.

BACKGROUND OF THE INVENTION

The present invention relates to a pallet arrangement for travelators, moving ramps, autowalks, escalators, and equivalents, herein collectively referred to as "people movers." Such a people mover includes a plurality of pallets arranged one after the other to form a track, wherein each pallet includes a pallet body, wheels attached to the pallet body and at least one surfacing element attached to the pallet body.

Travelators, like escalators, are conveying devices used to move people or goods. They differ from escalators, for example, in that they often work in a substantially horizontal position or in a position somewhat inclined relative to their direction of motion so that successive steps, or pallets, form a substantially even and linear track instead of step-like stairs as in escalators. Travelators are also referred to as moving sidewalks and autowalks.

In known people movers, the pallets are typically made in one piece from pressure-molded aluminum or some other suitable metal or metal alloy. A problem with these structures is that the pressure molding tools applicable for this purpose are very expensive. Another problem is that separate expensive tools are needed for each step or pallet type and for each width.

In addition, in prior-art pallet constructions, for example, plastic comb strips or equivalent are used as decorative or warning elements. A drawback with these solutions is that mounting the comb strips is a difficult and time-consuming operation because in prior-art constructions they are generally fastened by means of screws to the routed edges of the steps or pallets.

SUMMARY OF THE INVENTION

It is an object of the present invention to overcome the above-mentioned drawbacks It is a further object of the invention to achieve an easily variable pallet structure of economical cost for use in a travelator, autoramp, escalator or equivalent, a pallet structure that will also allow safety-improving solutions and various visual functions, such as the presentation of information or advertisements.

It is another object of the invention to provide a pallet structure that allows fast and economical maintenance of the pallets because the surfacing part is easily replaceable and additionally permits the replacement of worn parts only, making it unnecessary to replace the entire pallet due to wear of the surfacing.

The above and other objects of the invention are accomplished by a pallet arrangement for a people mover, comprising: a plurality of pallets arranged one after the other to form a track, each pallet comprising a pallet body, at least one surfacing element attached to the pallet body and a fastening mechanism to attach the at least one surfacing element to the pallet body, the fastening mechanism comprising at least one coupling element included in each surfacing element of the pallet, a form-locking groove included in the pallet body of the pallet and a locking element performing a locking operation with a locking movement and a releasing operation with a releasing movement, the locking element acting on all the coupling elements in the form-locking groove of the pallet body substantially simultaneously during the locking movement and the releasing movement.

The advantages of the pallet arrangement of the invention include low manufacturing costs and an easily variable surface structure consisting of different surfacing parts. A further advantage is improved user safety, because the light effects indicating the end of the track can be easily implemented so that they are better visible than in previously known solutions, and the gaps between steps or pallets can be sealed better than in prior-art solutions. Yet another advantage is that the surface of the pallets can be used better than before as a displaying surface for information or advertisements. Another advantage that maintenance of the equipment becomes easier and cheaper because only the surfacing parts subject to wear need to be replaced. An additional advantage is that the surfacing parts are fastened to the body of the step or pallet by form-locked snap-on couplings or equivalent that can be easily released and locked, allowing the joints to be easily uncoupled using a suitable tool. A further advantage are small investments on tools, and therefore the pallets, which are cut in suitable lengths from extruded long profiles, can be easily and quickly replaced with a structure of a different type or form when necessary.

BRIEF DESCRIPTION OF THE DRAWINGS

In the following, the invention will be described in detail with reference to an exemplary embodiment and the attached drawings, wherein.

DETAILED DESCRIPTION

Figure 1:
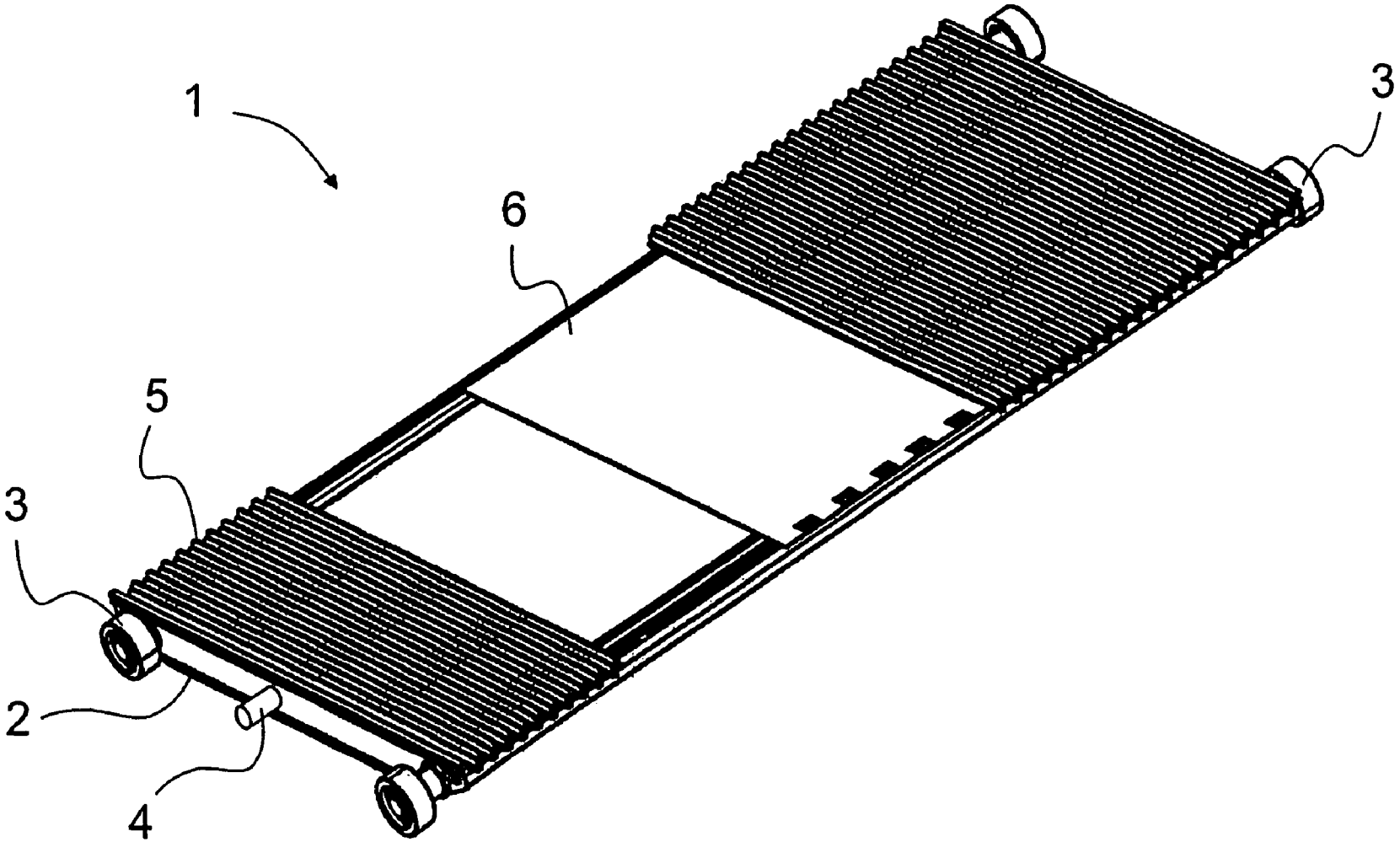
FIG. 1 presents a pallet according to the invention in a partially cutaway oblique top view.

Referring to FIG. 1, there is shown an exemplary embodiment of a pallet structure 1 for a people mover in the form of a travelator pallet structure 1 comprises a pallet body 3, preferably made by extruding a suitable profile from aluminum or some other appropriate metal or alloy. In the manufacture of the profile, a certain type of profile is extruded in bars of a length well suited for manufacture, transportation or other purposes. From the these profiled bars, parts of a length exactly appropriate for the purpose are cut later during manufacture of the pallet. Thus, the same profile can be easily used for pallets of different lengths, so the width of the moving track of the travelator can be easily varied. Fastened to the pallet body 2 are wheels 3 at each end of the pallet and likewise at at least one end a fastening element 4 used to connect the pallet 1 to an endless chain, cogged belt, rope or an equivalent means of moving the pallets. In addition, one or more surfacing elements 5 extruded from plastic or corresponding material which form the wearing surface of the pallets, which also contains the required corrugations in the direction of the track of motion of the pallets, are fastened onto the body 2 of the pallet. Placed between the lower surface of the surfacing element 5 and the upper surface of the pallet body 2 is additionally a baffle 6, which is intended to smooth out any unevenness between the surfacing element 5 and the body and to baffle clacking, squeaking or similar disturbing sounds. The baffle 6 may be a thin metal sheet or preferably a sheet of a material softer than metal, such as plastic, rubber or equivalent. The width of the surfacing elements 5 of the invention is so defined that, using a suitable number of surfacing elements 5 of the same width or different widths, it is possible to cover pallet bodies of different widths, so the same parts can be used to assemble pallets of different lengths.

Figure 2:
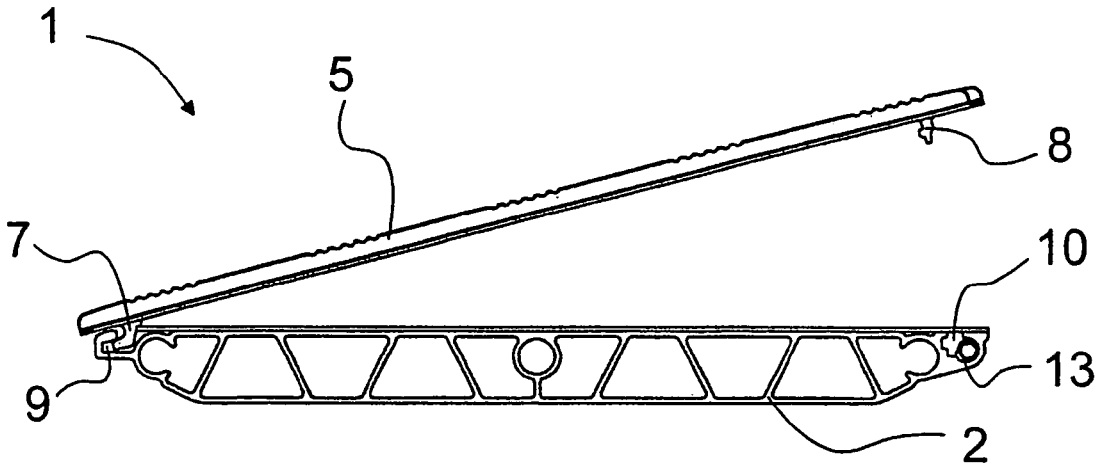
FIG. 2 presents a pallet according to the invention as seen from an end of the pallet and with the surfacing element pivoted apart from the pallet body.
Figure 3:
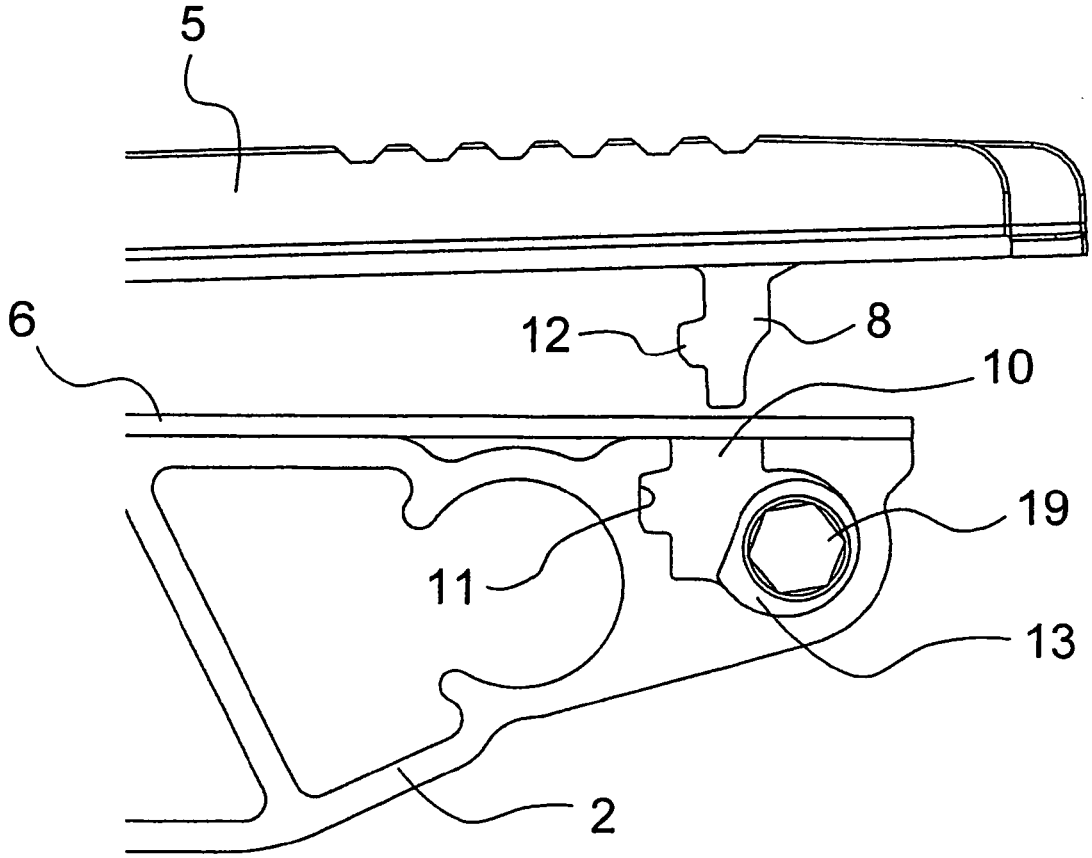
FIG. 3 presents an enlarged view of a portion of the pallet according to FIG. 2 with the surfacing element approaching a locking position.
Figure 4:
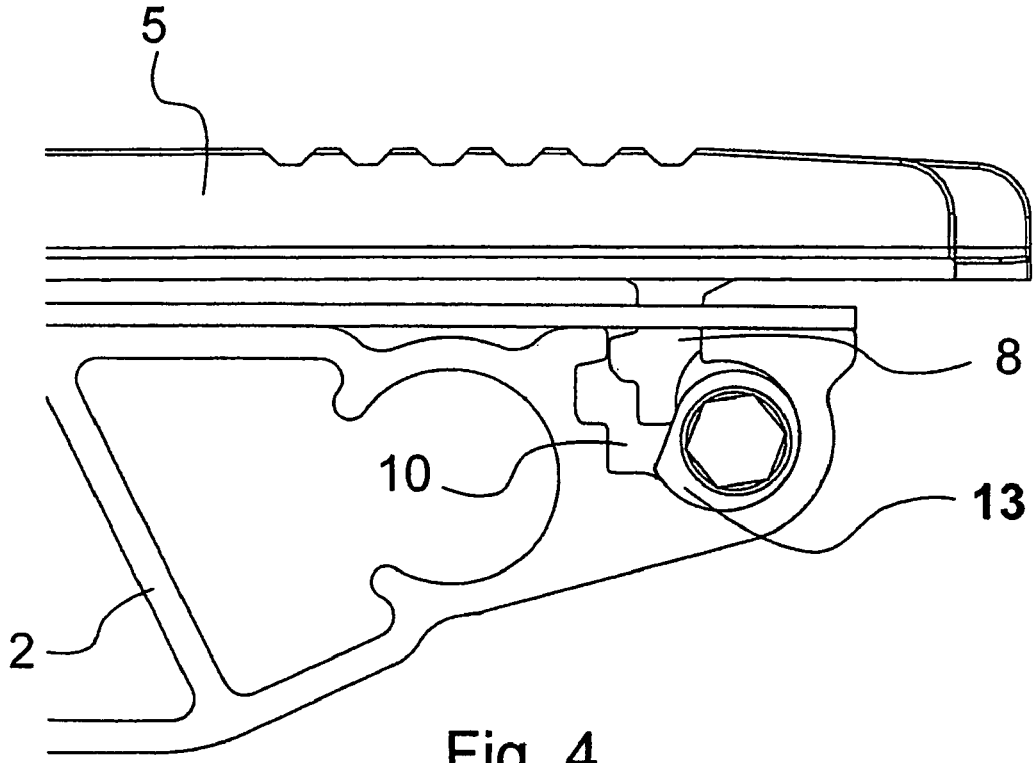
FIG. 4 presents an enlarged view of a portion of the pallet according to FIG. 2 with the surfacing element partly in its locking groove.

As seen from the end of the pallet as shown in FIG. 2, each surfacing element 5 has at each edge, preferably in the lower part or on the lower surface of the surfacing element, one or more form-locked coupling elements or similar coupling elements 7 and 8. The coupling elements 7 and 8 are disposed in suitable places at the ends of the surfacing element so that the surfacing elements are held firmly in place on the pallet body 2, and so that the surfacing elements can be easily pressed into position and likewise easily detached from the body with a suitable tool. Correspondingly, placed at suitable points substantially in the upper surface of the forward and rearward edges of the body 2 of the pallet are locking grooves 9 and 10 corresponding to the above-mentioned coupling elements, to which grooves the coupling elements 7 and 8 can be fastened by a form-locked coupling.

As seen from the end of the pallet, the upper surface of the first edge of the pallet body 2 is provided with a locking groove 9 of a substantially L-shaped cross-section with its lower projection or leg pointing towards the first edge of the pallet. The locking groove 9 has a length substantially covering the entire length of the pallet body 2. Correspondingly, the first edge of the surfacing element 5 is provided with one or more coupling elements 7 of L-shaped cross-section as seen from the end of the pallet, the lower projection or leg of the coupling element 7 extending towards the first edge of the surfacing element 5. The size and form of the coupling element 7 are adapted to the size and form of the locking groove 9 so that the surfacing element 5 can be locked by its first edge to the pallet body by inserting one or more coupling elements 7 into the locking groove 9 while the surfacing element 5 is in an inclined position and turning the surfacing element so that its lower surface becomes parallel to the upper surface of the pallet body.

Referring now to FIGS. 2-5, as seen from the end of the pallet, the upper surface of the second edge of the pallet body 2 is provided with a form-locking groove 10 located near the second edge and extending through the entire length of the pallet body 2. The inner edge of the groove 10 is provided with a recess 11 extending horizontally towards the middle part of the pallet body 2. Correspondingly, the inner surface of one or more coupling elements 8 near the second edge of the surfacing element 5 is provided with a projection 12 corresponding to the recess 11. In addition, placed in the form-locking groove 10 is a locking element 13 having a length substantially corresponding to the entire length of the pallet body 2, which element is, for example, an eccentric bar, one end of which bar has a nut 19 or a corresponding form which extends outside the end of the body 2 to allow the eccentric shaft to be turned about its longitudinal axis with a tool. The size and form of the coupling element 8 are adapted to the size and form of the form-locking groove 10 so that the surfacing element 5 can be locked by its second edge to the pallet body by pressing one or more of the coupling elements 8 into the form-locking groove 10 and locking one or all of the coupling elements 8 in position in the form-locking groove 10 by the locking element 13 in a single operation, with a single locking movement.

Figure 5:
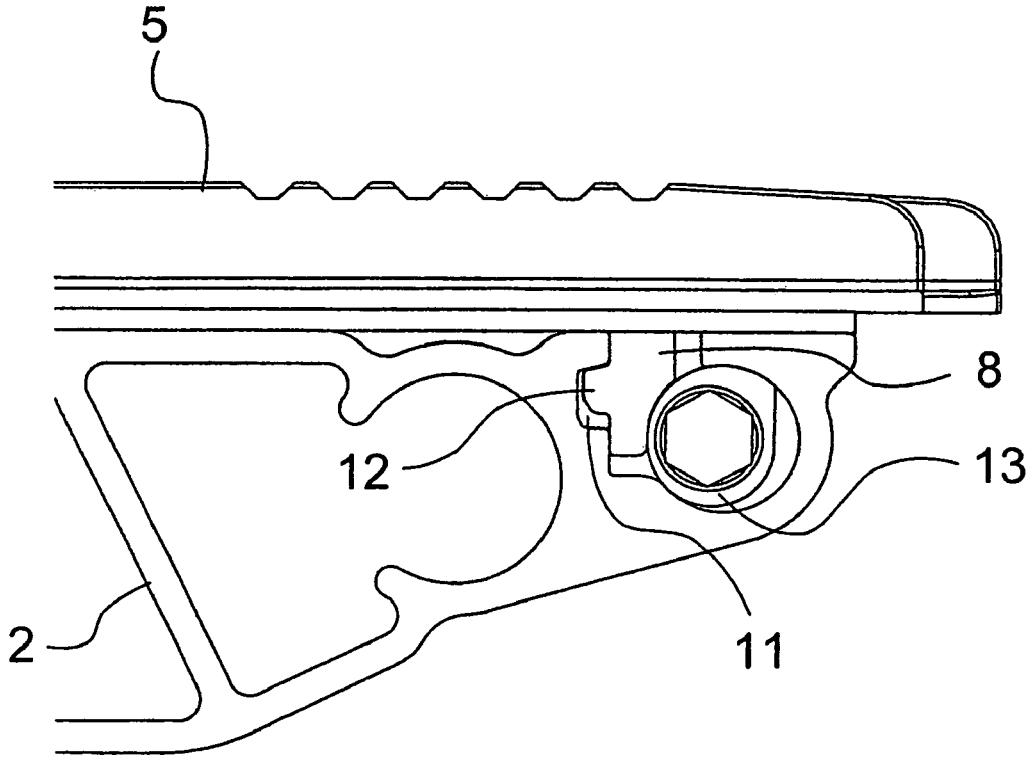
FIG. 5 presents an enlarge view of a portion of the pallet according to FIG. 2 with the surfacing element locked on the body of the pallet.

In the solution illustrated in FIG. 2-5, the locking is effected by turning the eccentric shaft of the locking element 13 by a suitable tool from the end of the eccentric shaft, thereby locking all the coupling elements 8 simultaneously. FIG. 5 illustrates a situation where the coupling element 8 has been locked in the form-locking groove 10 by the eccentric shaft of the locking element 13. In this situation, the projection 12 of the coupling element 8 is locked in the recess 11 of the form-locking groove 10.

Figure 6:
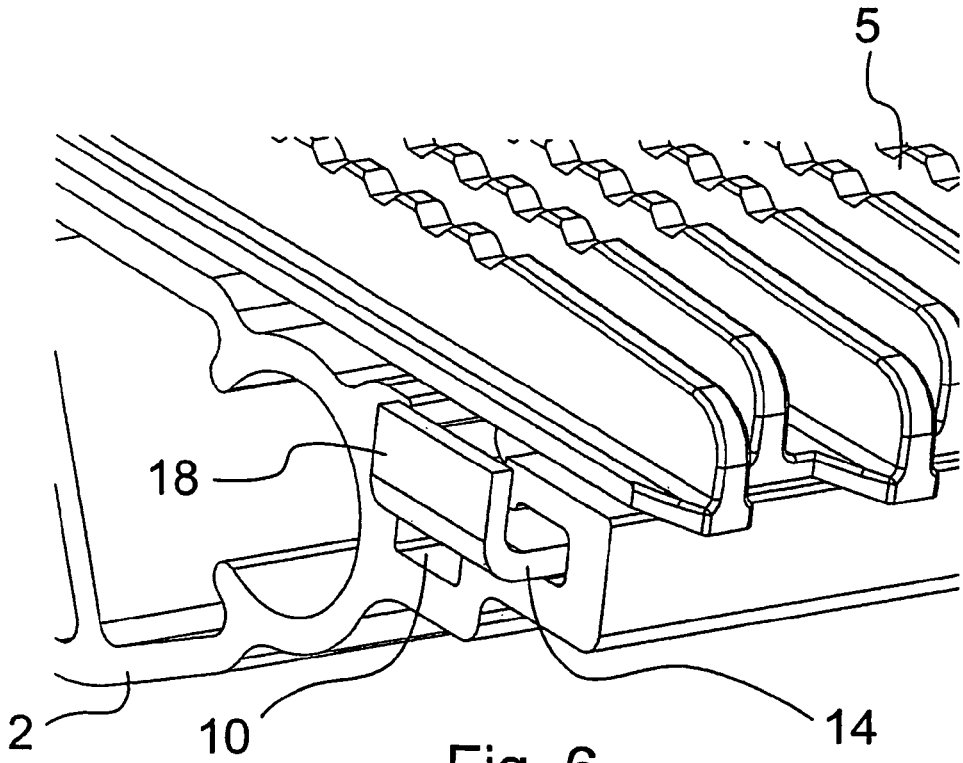
FIG. 6 presents an enlarged, perspective view from the end of a pallet according to another exemplary embodiment in with the surfacing element locked on the pallet body.
Figure 7:
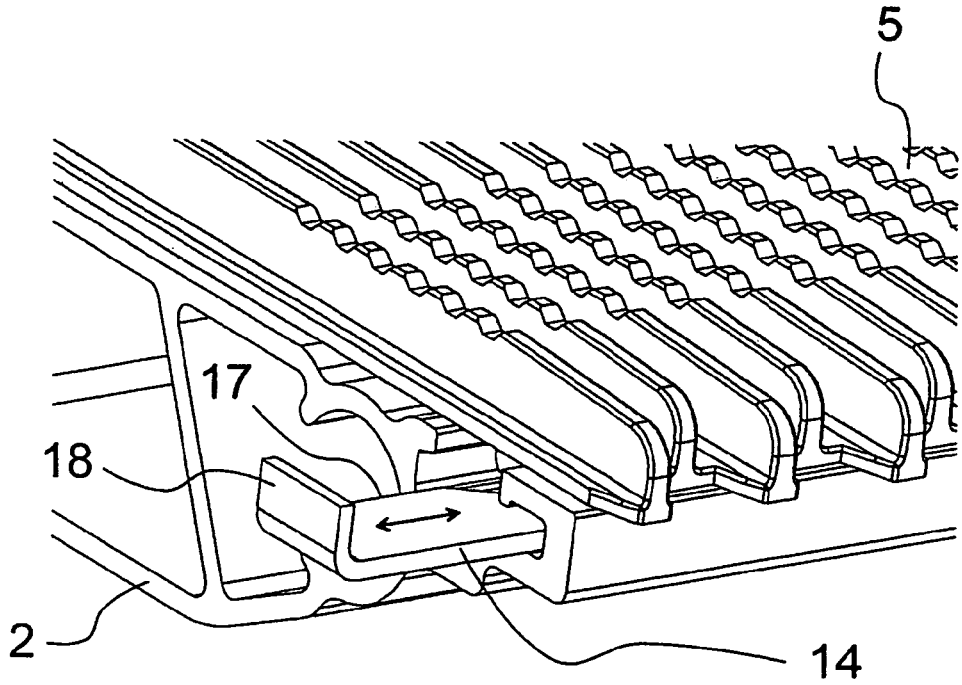
FIG. 7 presents the structure according to FIG. 6 with the locking of the surfacing element released.

FIGS. 6-10 present a second exemplary embodiment of the invention. In this embodiment, the surfacing element 5 and the coupling elements 7 and 8 have a structure substantially similar to that in the above-described first embodiment. Likewise, the locking groove 9 and the form-locking groove 10 are substantially identical to those in the structure according to the embodiment described above. The structural and functional difference consists of a different locking element 14, which locks the surfacing element 5 in place with a single linear locking movement in the longitudinal direction of the body 2. FIG. 6 presents a situation where the locking element 14 has been pushed into its locking position into the body 2, the surfacing element 5 being thus locked fast to the body 2. Correspondingly, FIG. 7 presents a situation where the locking element 14 has been pulled outwards from the end of the body 2 to a position where the surfacing element 5 is free to be lifted away from the locking groove 10.

Figure 8:
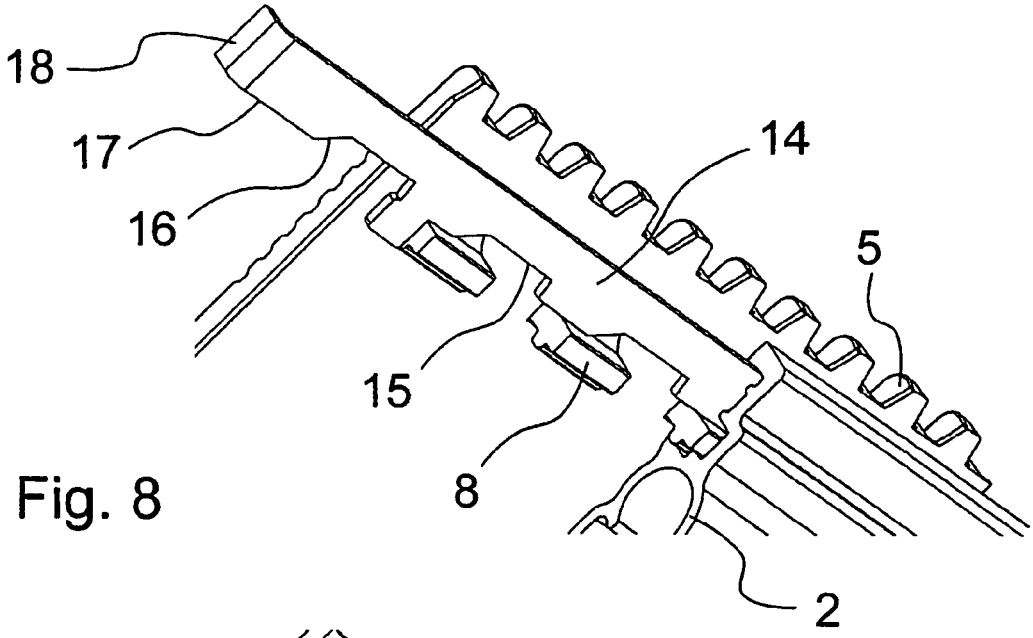
FIG. 8 presents a partially sectioned detail of the structure according to FIG. 6 in an oblique view from below the pallet and with the locking of the surfacing element activated.
Figure 9:
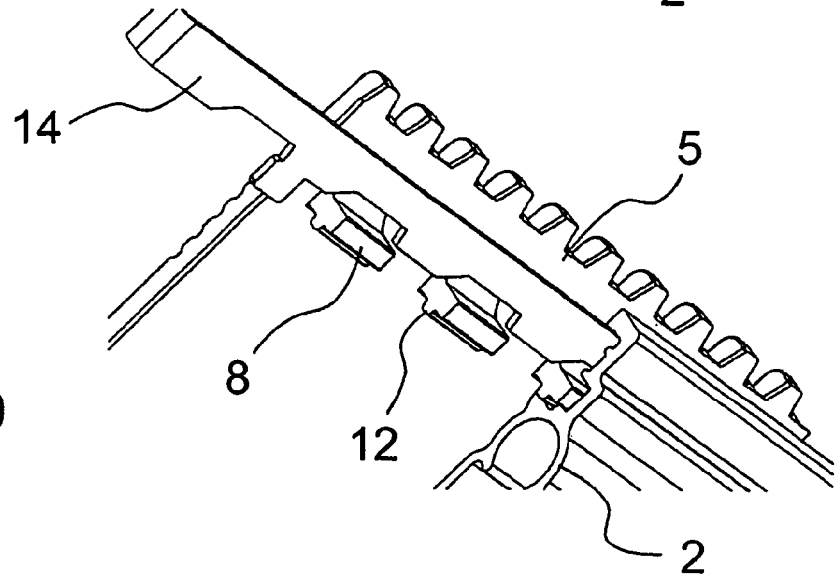
FIG. 9 presents a partially sectioned detail of the structure according to FIG. 6 in an oblique view from below the pallet and with the locking of the surfacing element released.
Figure 10:
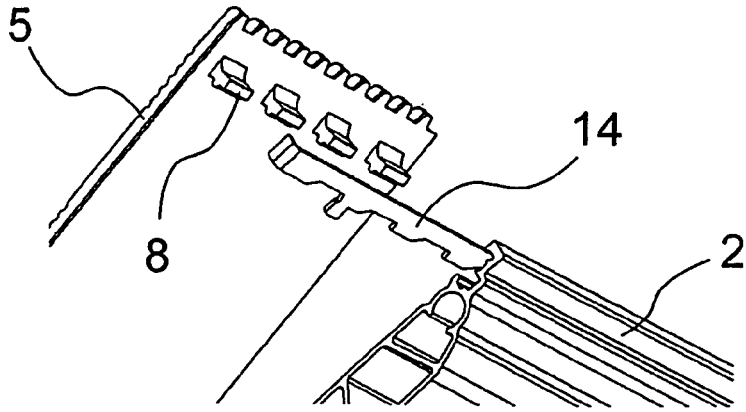
FIG. 10 presents a partially sectioned detail of the structure according to FIG. 6 in an oblique view from below the pallet and with the locking of the surfacing element released and with one surfacing element partly detached.

In FIGS. 8-10, the structure of the locking element 14 and its locked and released positions are shown in more detail as seen from below the body. For the sake of clarity, part of the end of the body has been cut off in the figures. The form of the form-locking groove 10 has been fitted to be such that a flat and rectangular locking element 14 resembling a flat bar in cross-section can slide in the form-locking groove 10 in the longitudinal direction of the pallet body 2. The locking element 14 also has a length substantially equal to the length of the pallet body 2, and the end of the locking element 14 extends outside the end of the body 2 and is configured, for example in the shape of an elbow, to allow the locking element to be easily moved. The inner edge 17 of the actual locking part is provided with cutouts 15 at regular distances, opening towards the midpart of the pallet body 2. The distance between the cutouts and their form and size correspond to the coupling elements 8 placed in a straight line at a horizontal distance from each other on the lower surface of the surfacing element. The rear edge of the cutout 15 is provided with a bevel 16 designed to allow the locking element 14 to be more easily pushed into the locking position, wherein the inner edge 17 of the locking element presses the coupling elements 8 by their outer surface against the inner edge of the form-locking groove 10. This causes the projections 12 of the coupling elements to be pressed into the recess 11 in the locking groove and the surfacing element 5 to be locked in place. To accomplish locking, the locking element 14 is pushed into position inside the body 2 or the locking element is struck on the elbow 18 at its end e.g. with a hammer to force the locking element in. In the locking operation all the coupling elements 8 are locked by the linear motion of the locking element 14 substantially simultaneously.

The surfacing element 5 is released by an operation converse with respect to the locking operation. The releasing is also accomplished by a single releasing movement that releases all the locking elements 8 simultaneously. When a locking element 13 according to FIGS. 2-5 is used, the surfacing element is released by turning the eccentric shaft of the locking element 13 by the nut 19 at the end of the shaft, for example with a fork wrench, until coupling element 8 is loosened in the form-locking groove 10, and lifting the coupling element 8 away from the form-locking groove 10 and pulling coupling element 7 obliquely away from the locking groove 9 at the first edge. Correspondingly, when a locking element 14 as illustrated in FIG. 6-10 is used, the locking of the coupling element 8 is released by pulling the locking element 14 outwards from the end of the body through a suitable distance and lifting the coupling elements 8 away from the form-locking groove 10.

The pallet of the invention may have surfacing elements 5 consisting of surface plates of different colors and also transparent or translucent surface plates. Under these transparent or translucent surface plates, between the body and the surface plate, it is possible to place, for example, a notice, advertisement or other element varying the appearance, printed on paper, plastic or similar material, which can be illuminated from below or from the side to produce different visual effects. The transparent or translucent surface plates are preferably placed in the middle part of the pallet 1. By placing surface plates of different colors at different positions in the longitudinal direction of the pallet 1, it is possible to vary the appearance of successive pallets, allowing the appearance of the moving track of the travelator to be easily changed and given a different look.

The solution of the invention also allows the gap between successive pallets 1 in the travelator to be made considerably wider than in prior-art solutions, even as much as about ten times wider depending on the surfacing solutions, so that the transparent or translucent gap thus formed can be illuminated from below to warn, for example, about the danger posed by the approaching end of the moving track. Because the attention-arousing effect of the warning light in the wide gap thus formed is very good, passengers concentrated on studying the notices or advertisements or equivalent can be effectively aroused to the danger caused by the approaching end of the moving track. When plastic elements are illuminated from the side, it is also possible to produce impressive illumination effects as the light is scattered, for example, at the crests of the corrugations mentioned above.

When required, a suitable sealing surface or some other applicable sealing structure, such as a sealing lip, can also be easily fastened to the extruded plastic surfacing element 5, the sealing being designed to close the gap between successive pallets 1. The use of sealings improves the operating safety, among other things, and prevents small objects from falling down into the mechanical structures of the travelator.

It is obvious to the person skilled in the art that the invention is not limited to the example described above, but that it may be varied within the scope of the claims presented below. Thus, the number, size and form as well as the functioning method of the locking grooves and locking elements may vary from that described above. Likewise, not all of the above-mentioned elements need necessarily to be used in the same pallet. A given pallet may be provided for example, with surface plates of only one type. Similarly, the material and method of manufacture of the pallet body may differ from the above description. Moreover, the size, form, structure and material of the surfacing elements may be different from those described above. Thus, for example, the surfacing part of the pallet may be made of a material other than plastic.

What is claimed is:

1. A pallet arrangement for a people mover, comprising:

a plurality of pallets arranged one after the other to form a track, each pallet comprising a pallet body, at least one surfacing element attached to the pallet body and a fastening mechanism to attach the at least one surfacing element to the pallet body, the fastening mechanism comprising at least one coupling element included in each surfacing element of the pallet, a form-locking groove included in the pallet body of the pallet and a locking element performing a locking operation with a locking movement and a releasing operation with a releasing movement, the locking element acting on the at least one coupling element in the form-locking groove of the pallet body during the locking movement and the releasing movement, the locking element comprising an elongated piece extending substantially in a longitudinal direction of the pallet body and having a length substantially equal to a length of the body.

2. The pallet arrangement according to claim 1, wherein the at least one coupling element comprises a first and a second coupling elements, wherein the locking element acts on the first and the second coupling elements in the form-locking groove of the pallet body substantially simultaneously during the locking movement and the releasing movement.

3. The pallet arrangement according to claim 1, wherein the locking element is located substantially inside the pallet body with one end of the locking element extends outside the end of the pallet body.

4. The pallet arrangement according to claim 3, wherein the end of the locking element extending outside the pallet body has a form that allows the locking element to be easily moved to implement the locking and releasing movements.

5. The pallet arrangement according to claim 1, wherein the locking element comprise an eccentric bar having a longitudinal axis about which the eccentric bar is turnable, the eccentric bar having eccentric cams fitted to press the locking element in the form-locking groove into a locked position.

6. The pallet arrangement according to claim 1, wherein the locking element comprises a flat bar linearly movable in a longitudinal direction of the pallet body and including cutouts, the flat bar including an inner edge adapted to press the coupling element into a locked position in the form-locking groove.

7. The pallet arrangement according to claim 1, wherein the pallet body includes a first edge having a locking groove with a substantially L-formed cross-section, the at least one coupling element includes a coupling element in a lower surface of the surfacing element having a corresponding L-formed cross-section that fits into the L-formed groove in the pallet body, and the pallet body has a second edge including the form-locking groove and the at least one coupling element includes a coupling element in the lower surface of the surfacing element that fits into the form-locking groove and is lockable by the locking element.

8. The pallet arrangement according to claim 7, wherein the locking groove at the first edge of the surfacing element and the form-locking groove at the second edge of the surfacing element have substantially equal lengths and are substantially unchanged in cross-section over their entire length.

* * * * *